US008425186B2

(12) United States Patent
Higashimori

(10) Patent No.: US 8,425,186 B2
(45) Date of Patent: Apr. 23, 2013

(54) CENTRIFUGAL COMPRESSOR

(75) Inventor: Hirotaka Higashimori, Nagasaki-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 353 days.

(21) Appl. No.: 12/745,434

(22) PCT Filed: Jun. 24, 2008

(86) PCT No.: PCT/JP2008/061443

§ 371 (c)(1),
(2), (4) Date: Sep. 7, 2010

(87) PCT Pub. No.: WO2009/078186

PCT Pub. Date: Jun. 25, 2009

(65) Prior Publication Data

US 2011/0002780 A1 Jan. 6, 2011

(30) Foreign Application Priority Data

Dec. 19, 2007 (JP) ..... 2007-326733

(51) Int. Cl.
*F04D 29/28* (2006.01)
*F04D 29/30* (2006.01)

(52) U.S. Cl.
USPC ..... 415/203; 415/206; 416/179; 416/185; 416/188; 416/223 B

(58) Field of Classification Search ..... 416/179, 416/182, 184, 185, 186 R, 188, 223 B; 415/203, 415/206
See application file for complete search history.

(56) References Cited

U.S. PATENT DOCUMENTS

| | | | | |
|---|---|---|---|---|
| 2005/0196273 | A1* | 9/2005 | Nishikawa et al. | 415/206 |
| 2005/0254954 | A1 | 11/2005 | Higashimori et al. | |
| 2010/0129209 | A1* | 5/2010 | Sugimoto et al. | 415/203 |

FOREIGN PATENT DOCUMENTS

| | | | |
|---|---|---|---|
| JP | 04-132898 | A | 5/1992 |
| JP | 2002-031094 | A | 1/2002 |
| JP | 2006-009748 | A | 1/2006 |
| JP | 2006-336486 | A | 12/2006 |
| KR | 10-1993-0004642 | B1 | 6/1993 |
| KR | 10-1995-0027209 | A | 10/1995 |
| KR | 10-2002-0084613 | A | 11/2002 |
| WO | 2005/052376 | A1 | 6/2005 |

OTHER PUBLICATIONS

Krain, H., "Swirling Impeller Flow", Transactions of the ASME, Jan. 1988, p. 122-128, vol. 110.
"Turbocharger Maintenance: Optimizing Preventive Maintenance", ABB Catalogue, 2003, p. 1-11, ABB Turbo Systems, Ltd.

(Continued)

*Primary Examiner* — Nathaniel Wiehe
*Assistant Examiner* — Justin Seabe
(74) *Attorney, Agent, or Firm* — Westerman, Hattori, Daniels & Adrian, LLP

(57) ABSTRACT

To provide a centrifugal compressor having a high pressure ratio, which can achieve a large flow rate while suppressing a decrease in efficiency, the centrifugal compressor being adapted to compress and discharge a gas, which has been sucked in by rotation of an impeller (10) pivotally supported in a casing (11), mainly by centrifugal force, the inlet radius/outlet radius ratio (R1/R2) of the impeller (10) is set at $0.7 \leqq R1/R2 \leqq 0.85$, and the inclination angle (74 ) of a back board portion in a hub (10*a*) of the impeller (10) is set at $5° \leqq \theta \leqq 15°$.

8 Claims, 4 Drawing Sheets

OTHER PUBLICATIONS

International Search Report of PCT/JP2008/061443, Mailing Date of Sep. 30, 2008.

Korean Notoce of Allowance (Decision for Grant of Patent) dated Nov. 8, 2012, issued in corresponding Korean Patent Application No. 10-2010-7013259, with English translation (3 pages).

* cited by examiner

CENTRIFUGAL COMPRESSOR

TECHNICAL FIELD

This invention relates to a centrifugal compressor which is used in a supercharger, a small gas turbine, etc. More specifically, the present invention relates to a centrifugal compressor having a high pressure ratio, which can achieve a large flow rate or an increase in a flow rate while suppressing a decrease in efficiency.

BACKGROUND ART

With a product such as a supercharger, a gas turbine, or an industrial compressor, "an increase in a flow rate" is an important challenge in improving performance. The term "increase in the flow rate (increase in the capacity)" of a centrifugal compressor refers to increasing a discharge flow rate in the compressor of the same shell size. Generally, the outer diameter of an impeller is used as a reference dimension. In other words, the increase in the flow rate refers to increasing the discharge flow rate in the impeller of the same outer diameter.

As a mutually exclusive event for this "increase in the flow rate", "a decrease in efficiency" poses a problem. A "technology for achieving an increased or large flow rate while suppressing a decrease in efficiency" is very meaningful in the industrial field.

On the other hand, "an increase in pressure ratio" is an important technical requirement. This is because the increased pressure ratio can lead to a high output and a high efficiency with a small reciprocating engine in a supercharger (turbocharger) to which a centrifugal compressor is applied. In a gas turbine as well, the increased pressure ratio enables a high output and a high efficiency to be obtained with a small engine. In a supercharger, in particular, when the required pressure ratio is increased to 4 to 5, there is a simultaneously growing demand for the increased flow rate. With such a centrifugal compressor having a high pressure ratio, a decrease in the efficiency associated with the increase in the flow rate is marked. Thus, the "technology for achieving an increased or large flow rate while suppressing a decrease in efficiency in a centrifugal compressor having a high pressure ratio (4 to 5)" is of industrially significant importance.

Non-Patent Document 1: Transactions of the ASME 126/Vol. 110 JANUARY 1988

DISCLOSURE OF THE INVENTION

Problems to be Solved by the Invention

The cause of the decrease in the efficiency associated with the increase in the flow rate is generally recognized as follows:

FIG. 6 shows the configuration of a conventional centrifugal compressor and the shape of an impeller in it. An impeller 100 comprises a plurality of blades 100*b* fixedly provided, by welding or the like, with circumferentially predetermined spacing on the outer periphery of a hub 100*a*, each of the blades comprising a thin plate. The impeller 100 is rotatably and pivotally supported within a casing 101 and, by rotation of the impeller 100, a flow is sucked in from the inlet of the impeller in the axial direction (see a hollow arrow showing the amount of movement in the axial direction at the inlet of the impeller), whereupon the energy of a swirl is imparted to the flow. At the outlet of the impeller, static pressure rises, resulting in an outflow at a great swirling flow velocity. This energy of the swirl is decelerated by a diffuser 102, and is converted thereby into an increase in pressure. The flow at the exit of the diffuser is collected throughout the circumference by a scroll 103 of a volute shape, and is flowed out as a stream in a duct heading in a tangential direction.

A supercharger or a small gas turbine is designed such that the pressure ratio at which air is compressed is 2 or more, and the maximum value of the swirling velocity or tangential velocity at the outlet of the impeller is 400 m/s or more. The inlet of the impeller is configured such that the front edge of the blade 100*b* heads in a practically radial direction in order to withstand high stress due to centrifugal force. Furthermore, the outlet of the impeller is configured such that the back board surface of the hub 100*a* is in the shape of a disk heading in the radial direction to point the flow in the radial direction, and the rear edge of the blade 100*b* is nearly parallel to the rotating shaft and, even if it is inclined, a dimensional difference between the side of the hub 100*a* and the front end side of the blade 100*b* is within 5% of the average diameter.

In the centrifugal compressor constructed by the above-mentioned features, the flow in the impeller 100 at a medium to small flow rate is shown in FIG. 7*a*. The distinction between the impeller at a large flow rate and the impeller at a medium to small flow rate uses as an index the inlet radius/outlet radius ratio of the impeller 100, R11/R21, at 0.7. In the present invention, the compressor with R11/R21≧0.7 is defined as the compressor at a large flow rate, and the impeller satisfying this range is involved in the present invention.

In the impeller 100 at a medium to small flow rate, the flow at the outlet of the impeller substantially points in the radial direction (see a flow velocity distribution indicated by arrows in FIG. 7*a*). If the diffuser is designed appropriately, this flow can be converted into pressure with a small loss. With the impeller 100 at a large flow rate, the inlet radius/outlet radius ratio is often set at R11/R21=0.7 to 0.8 and, in some cases, set at 0.85 or so. If this ratio exceeds 0.8, however, a decrease in the efficiency is so great that practical use is generally impossible.

The reason is that if the inlet radius/outlet radius ratio exceeds 0.7, the amount of axial movement at the inlet of the impeller is not eliminated to zero before the outlet of the impeller, but a velocity in the axial direction remains at the outlet of the impeller. To reduce this amount of axial movement at the inlet of the impeller to zero, the need for an area two times or more the area of the inlet of the impeller has been theoretically demonstrated. Thus, the ratio of the outlet radius R21 to the inlet radius R11 of the impeller 100 is $\sqrt{2}$=1.414, its reciprocal being R11/R21≈0.7.

In short, with the impeller at a large flow rate having the inlet radius/outlet radius ratio R11/R21≧0.7, the problem arises that the flow at the outlet of the impeller is biased toward the back board portion of the hub 100*a* as shown in FIG. 7*b* (see a flow velocity distribution indicated by arrows in FIG. 7*b*). If this based flow occurs, the rise in static pressure up to the outlet of the impeller declines, causing the industrial disadvantage that the impeller efficiency lowers. In the downstream diffuser, moreover, the problem develops that even if the shape of the diffuser is worked out, the loss in the diffuser cannot be curtailed. This leads to the problem that the loss in the entire centrifugal compressor increases, and the efficiency decreases.

It is an object of the present invention, therefore, to provide a centrifugal compressor having a high pressure ratio, which can achieve a large flow rate or an increase in a flow rate while suppressing a decrease in efficiency.

Means for Solving the Problems

The centrifugal compressor according to the present invention, intended to solve the above-mentioned problems, is a centrifugal compressor adapted to compress and discharge a gas, which has been sucked in by rotation of an impeller pivotally supported in a casing, mainly by centrifugal force, characterized in that an inlet radius/outlet radius ratio (R1/R2) of the impeller is set at 0.7≦R1/R2≦0.85, and an inclination angle (θ) of a back board portion in a hub of the impeller is set at 5°≦θ≦15°.

The centrifugal compressor is also characterized in that when a relation drawing of (R1/R2)–θ is made for an optimum value of the inclination angle, a straight line connecting points corresponding to θ=5° for R1/R2=0.7, and θ=15° for R1/R2=0.85 is taken as the optimum inclination angle, and the inlet radius/outlet radius ratio (R1/R2) of the impeller and the inclination angle (θ) of the back board portion in the hub are set within a range of ±5° from the straight line.

The centrifugal compressor is also characterized in that the inclination angle (θ) of the back board portion is applied to the impeller having an impeller outlet peripheral velocity of 400 m/s or more, and preferably, is applied to the impeller having an impeller outlet peripheral velocity of 450 m/s or more which produces a remarkable effect.

The centrifugal compressor is also characterized in that inlet side wall surfaces of the diffuser connected to a downstream site of the impeller are composed of curves continuous with, or straight lines connected to, slopes of wall surfaces of an outlet of the impeller over a predetermined range.

Effects of the Invention

According to the centrifugal compressor concerned with the present invention, the inlet radius/outlet radius ratio of the impeller is rendered as high as possible to achieve a large flow rate, whereas the inclination angle of the back board portion in the hub of the impeller is set at the optimum value, whereby a decrease in the compressor efficiency can be prevented.

DESCRIPTION OF THE NUMERALS

10 Impeller
10*a* Hub
10*b* Blade
11 Casing
12 Diffuser
12*a* Inlet side wall surface of diffuser
13 Scroll

BEST MODE FOR CARRYING OUT THE INVENTION

A centrifugal compressor according to the present invention will be described in detail by the following embodiments using drawings.

Embodiment 1

Figure 1:
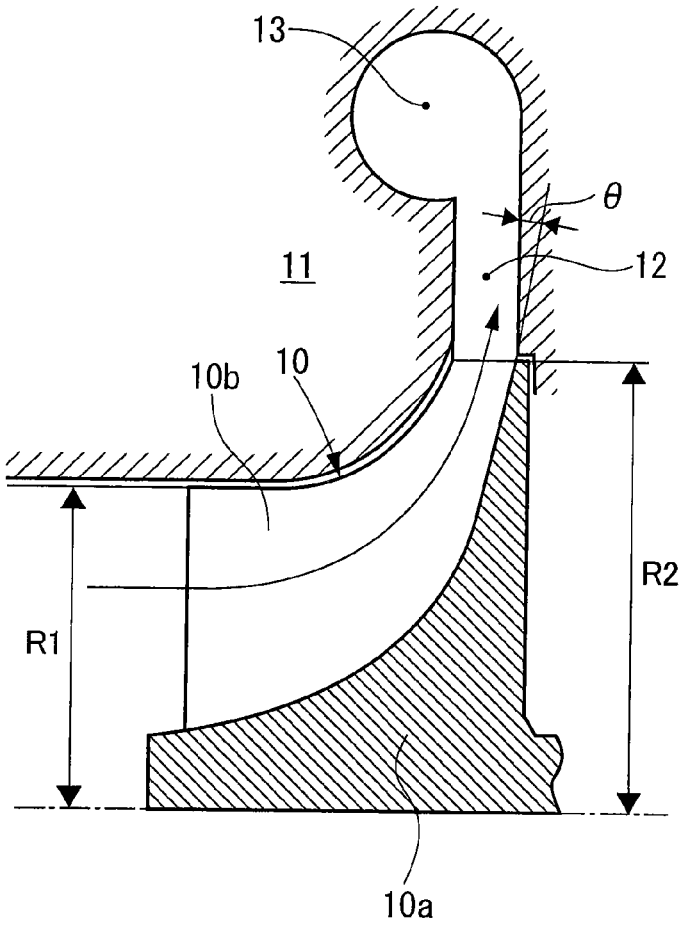
FIG. 1 is a sectional view of essential parts of a centrifugal compressor showing Embodiment 1 of the present invention.
Figure 2:
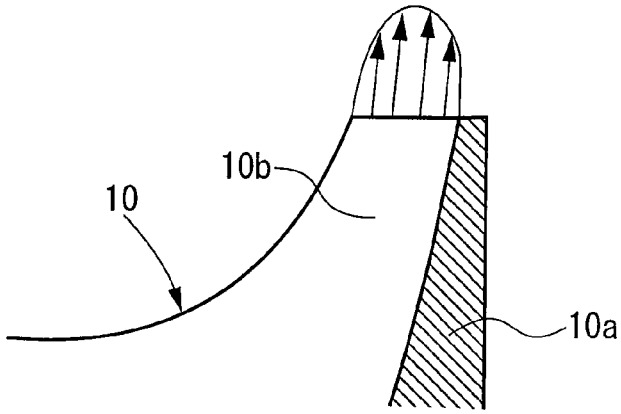
FIG. 2 is an explanation drawing of actions.
Figure 3:
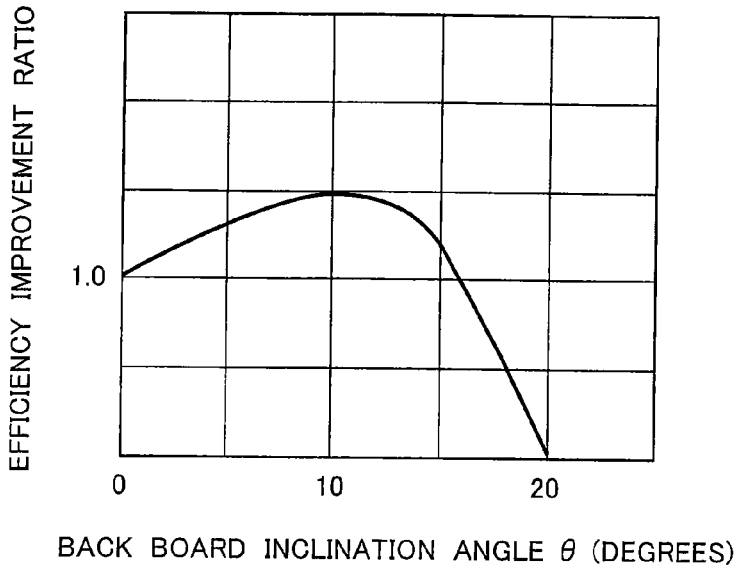
FIG. 3 is a graph showing the relationship between a back board inclination angle and an efficiency improvement ratio.
Figure 4:
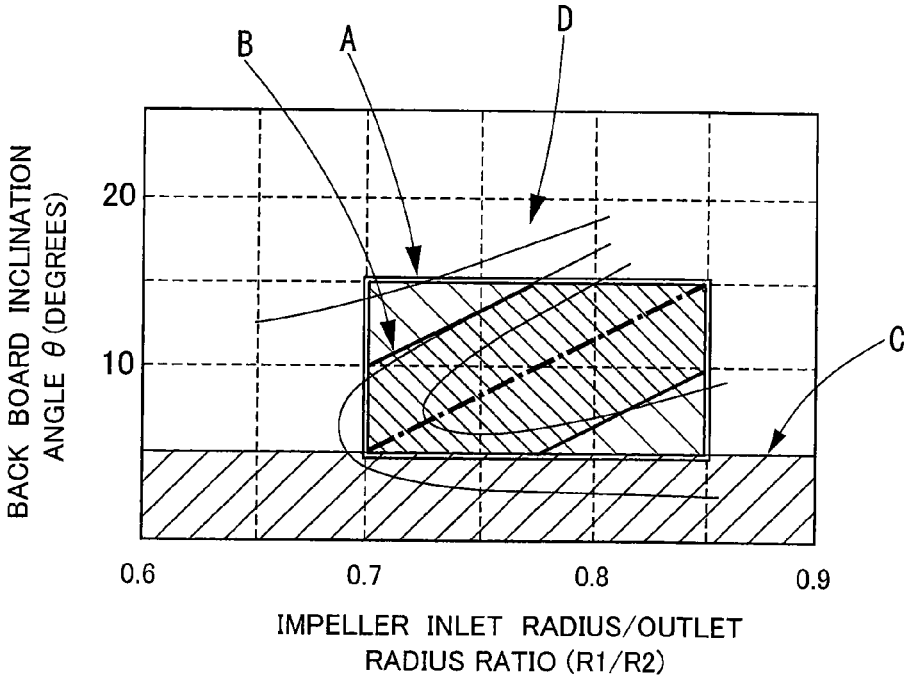
FIG. 4 is a graph showing the relationship between the inlet radius/outlet radius ratio of the impeller and the back board inclination angle.

FIG. 1 is a sectional view of essential parts of a centrifugal compressor showing Embodiment 1 of the present invention. FIG. 2 is an explanation drawing of actions. FIG. 3 is a graph showing the relationship between a back board inclination angle and an efficiency improvement ratio. FIG. 4 is a graph showing the relationship between the inlet radius/outlet radius ratio of an impeller and the back board inclination angle.

In the centrifugal compressor, as shown in FIG. 1, an impeller 10 comprises a plurality of blades 10*b* fixedly provided, by welding or the like, with predetermined spacing in the circumferential direction on the outer periphery of a hub 10*a*, each of the blades comprising a thin plate. The impeller 10 is rotatably and pivotally supported within a casing 11 and, by rotation of the impeller 10, a flow is sucked in from the inlet of the impeller in the axial direction, whereupon the energy of a swirl is imparted to the flow. At the outlet of the impeller, static pressure rises, resulting in an outflow at a great swirling flow velocity. This energy of the swirl is decelerated by a diffuser 12, and is converted thereby into an increased pressure. The flow at the exit of the diffuser is collected throughout the circumference by a scroll 13 of a volute shape, and is flowed out as a stream in a duct pointing in a tangential direction.

When used in a supercharger or a small gas turbine, the centrifugal compressor is designed as follows: The tangential velocity (peripheral velocity) at the outlet of the impeller is set at 400 m/s or more. When the pressure ratio at which air is compressed is 4 to 5 or more, the maximum value of the tangential velocity (peripheral velocity) at the outlet of the impeller is set al 450 m/s or more. The inlet of the impeller is configured to have the front edge of the blade 10*b* pointing in a practically radial direction in order to withstand high stress due to centrifugal force. Furthermore, the rear edge of the blade 10*b* is configured to be nearly parallel to the rotating shaft and, even if it is inclined, a dimensional difference between the side of the hub 10*a* and the front end side of the blade 10*b* is within 5% of the average diameter.

In the present embodiment, as shown in FIG. 4, the inlet radius/outlet radius ratio (R1/R2) of the impeller 10 is set at 0.7≦R1/R2≦0.85, and the inclination angle of the back board portion in the hub 10*a* of the impeller 10 (i.e., back board inclination angle θ) is set at 5°≦θ≦15° (see a region A in FIG. 4).

Preferably, as shown in FIG. 4 as well, the optimum back board inclination angle θ is determined as follows: When a relation drawing of (R1/R2)–θ is made, θ=5° for R1/R2=0.7, and θ=15° for R1/R2=0.85. A straight line (dashed dotted line) connecting the corresponding points fulfilling these relations is taken as representing the optimum inclination angle. Within the range of ±5° from this straight line (see a region B in FIG. 4), there are set the inlet radius/outlet radius ratio (R1/R2) of the impeller 10 and the back board inclination angle θ in the hub 10*a*.

Figure 7A:
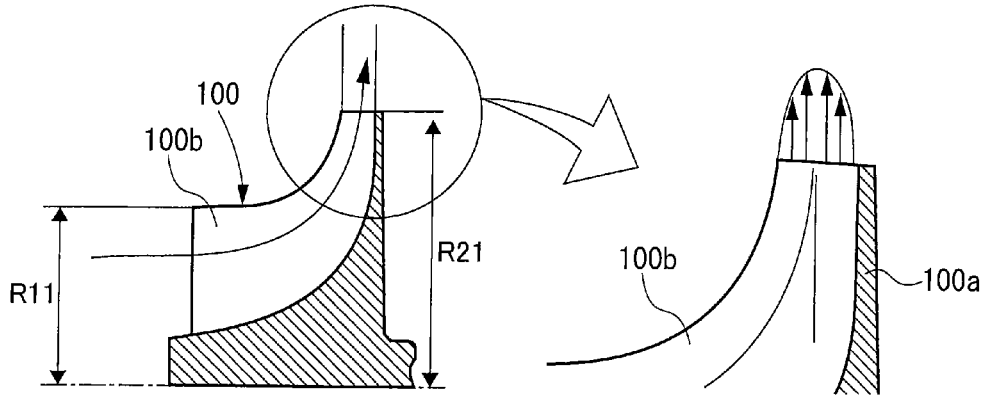
FIG. 7*a* is an explanation drawing of a gas flow in the impeller at a medium to small flow rate.
Figure 7B:
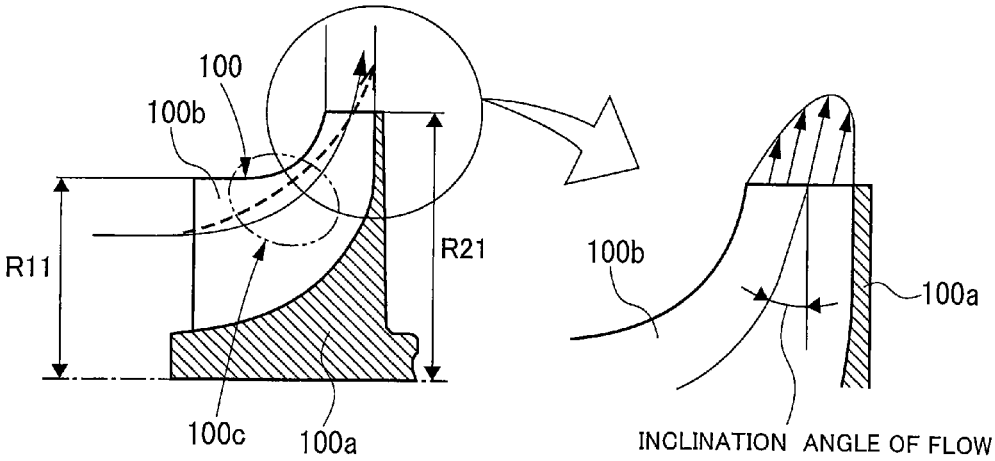
FIG. 7*b* is an explanation drawing of a gas flow in the impeller at a large flow rate.

In an intermediate region 100*c* of the impeller at a large flow rate in FIG. 7*b* (a region where the direction of the flow is changed from the axial direction into the radial direction), when the peripheral velocity at the outlet of the impeller becomes high, there is an increased tendency for the flow to be biased toward the shroud (see a streamline indicated by a dashed line in the intermediate region 100*c*) because of the effect of centrifugal force. Thus, the inclination angle of the flow at the outlet of the impeller increases. This tendency becomes conspicuous when the peripheral velocity at the outlet of the impeller exceeds 450 m/s. As a result, a decrease in the efficiency due to the increased flow rate is noticeable. Thus, it is preferred to apply the aforementioned back board inclination angle θ.

In the present embodiment, as described above, the inlet radius/outlet radius ratio of the impeller 10 is rendered as high as possible to achieve a large flow rate, whereas the back board inclination angle θ in the hub 10*a* of the impeller 10 is set at the optimum value. Hence, a decrease in the compressor efficiency can be prevented.

That is, as shown in FIG. 2, the inclination angle of the flow at the outlet of the impeller 10 remains to be a value of the order of the back board inclination angle. However, the flow velocity distribution indicated by arrows in FIG. 2 approaches a laterally substantially similar flow velocity distribution with respect to the center of the width of the outlet of the impeller. Thus, the rise in the static pressure up to the outlet of the impeller 10 is improved to increase the impeller efficiency.

As is known from Non-Patent Document 1, etc., if the back board inclination angle θ is increased too much, the problem arises that the efficiency lowers markedly, as shown by the relation between the back board inclination angle θ and the compressor efficiency at a certain representative radius ratio illustrated in FIG. 3. As shown by the region A or B in FIG. 4, therefore, the optimum value exists with respect to the inlet radius/outlet radius ratio of the impeller 10. A region C in FIG. 4 shows the case of the impeller in an ordinary centrifugal compressor, and a region D shows a region where the efficiency lowers. Contour lines in FIG. 4 show the amounts of the increase in the efficiency relative to the back board inclination angle θ=0° at a constant inlet radius/outlet radius ratio of the impeller.

Embodiment 2

Figure 5:
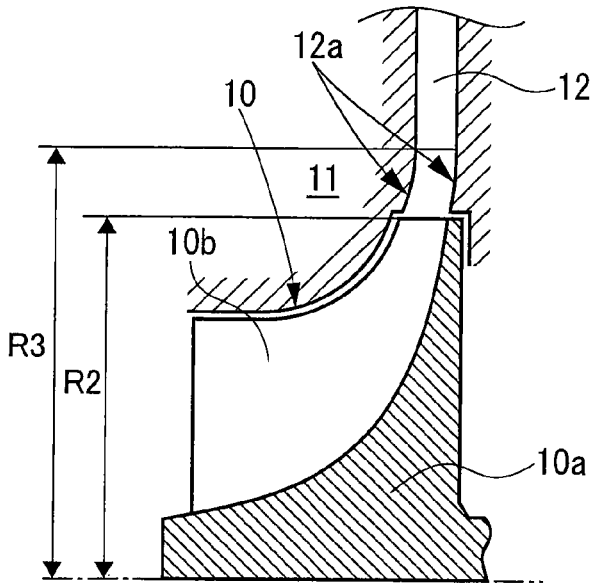
FIG. 5 is a sectional view of essential parts of a centrifugal compressor showing Embodiment 2 of the present invention.
Figure 6:
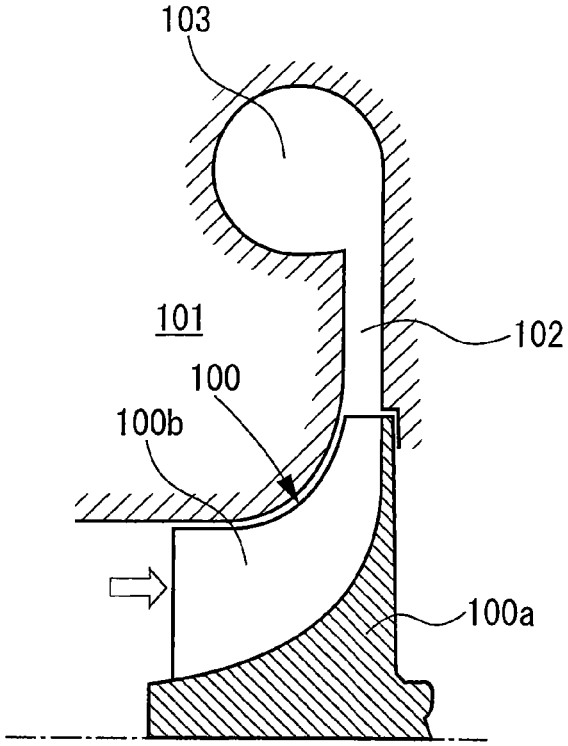
FIG. 6 is a sectional view of essential parts of a conventional centrifugal compressor.

FIG. 5 is a sectional view of essential parts of a centrifugal compressor showing Embodiment 2 of the present invention.

This is an embodiment in which the inlet side wall surfaces 12*a* of the diffuser 12 in Embodiment 1 are composed of curves continuous with, or straight lines connected to, the outlet wall surface slopes of the impeller 10 in a region defined by R3/R2<1.15 where R3/R2 is the radius ratio.

In Embodiment 1, the symmetry of the flow velocity distribution at the outlet of the impeller 10 is improved, but the problem exists that the inclination of the flow at the outlet of the impeller 10 remains unchanged, as shown in FIG. 2. If such a flow flows into the diffuser 12, and if the outlet of the impeller is connected to a disk-shaped diffuser 12 having radial lines in the shape of a meridional plane, as the downstream diffuser 12, it is necessary to make the inclination of the flow within the diffuser virtually parallel to the diffuser wall.

Thus, if the conventional disk-shaped diffuser is installed as the diffuser 12, the problem occurs that a loss at the entrance of the diffuser increases owing to a sudden change in the angle of the flow. This problem is solved by constituting the diffuser 12 as in the present embodiment.

INDUSTRIAL APPLICABILITY

The centrifugal compressor according to the present invention is preferred when used in a supercharger, a gas turbine, an industrial compressor, etc.

The invention claimed is:

1. A centrifugal compressor adapted to compress and discharge a gas, which has been sucked in by rotation of an impeller pivotally supported in a casing, mainly by centrifugal force, wherein an inlet radius/outlet radius ratio (R1/R2) of the impeller is set at 0.7≦R1/R2≦0.85, and an inclination angle (θ) of a back board portion in a hub of the impeller is set at 5°≦θ≦15°.

2. The centrifugal compressor according to claim 1, wherein when a relation drawing of (R1/R2)−θ is made for an optimum value of the inclination angle, a straight line connecting points corresponding to θ=5° for R1/R2=0.7, and θ=15° for R1/R2=0.85 is taken as the optimum inclination angle, and the inlet radius/outlet radius ratio (R1/R2) of the impeller and the inclination angle (θ) of the back board portion in the hub are set within a range of ±5° from the straight line.

3. The centrifugal compressor according to claim 1, wherein the inclination angle (θ) of the back board portion is applied to the impeller having an impeller outlet peripheral velocity of 400 m/s or more.

4. The centrifugal compressor according to claim 2, wherein the inclination angle (θ) of the back board portion is applied to the impeller having an impeller outlet peripheral velocity of 400 m/s or more.

5. The centrifugal compressor according to claim 1, wherein inlet side wall surfaces of the diffuser connected to a downstream site of the impeller are composed of curves continuous with, or straight lines connected to, slopes of wall surfaces of an outlet of the impeller over a predetermined range.

6. The centrifugal compressor according to claim 2, wherein inlet side wall surfaces of the diffuser connected to a downstream site of the impeller are composed of curves continuous with, or straight lines connected to, slopes of wall surfaces of an outlet of the impeller over a predetermined range.

7. The centrifugal compressor according to claim 3, wherein inlet side wall surfaces of the diffuser connected to a downstream site of the impeller are composed of curves continuous with, or straight lines connected to, slopes of wall surfaces of an outlet of the impeller over a predetermined range.

8. The centrifugal compressor according to claim 4, wherein inlet side wall surfaces of the diffuser connected to a downstream site of the impeller are composed of curves continuous with, or straight lines connected to, slopes of wall surfaces of an outlet of the impeller over a predetermined range.

* * * * *

UNITED STATES PATENT AND TRADEMARK OFFICE

CERTIFICATE OF CORRECTION

PATENT NO. : 8,425,186 B2
APPLICATION NO. : 12/745434
DATED : April 23, 2013
INVENTOR(S) : Hirotaka Higashimori It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 488 days.

Signed and Sealed this
Eighth Day of September, 2015

Michelle K. Lee

Michelle K. Lee
*Director of the United States Patent and Trademark Office*